US005197608A

United States Patent [19]

Stangenberg et al.

[11] Patent Number: 5,197,608

[45] Date of Patent: Mar. 30, 1993

[54] FEED MECHANISM TO A DOCUMENT SHREDDER

[75] Inventors: Hartmut Stangenberg, Owingen; Rolf Gasteier, Markdorf, both of Fed. Rep. of Germany

[73] Assignee: Schleicher & Co. International Aktiengesellschaft, Fed. Rep. of Germany

[21] Appl. No.: 669,762

[22] Filed: Mar. 15, 1991

[30] Foreign Application Priority Data

Mar. 17, 1990 [DE] Fed. Rep. of Germany ..... 4008653

[51] Int. Cl.[5] ..... A47F 7/00

[52] U.S. Cl. ..... 211/50; 211/181

[58] Field of Search ..... 211/50, 13, 181, 45; 400/613.2, 613, 611; 248/153

[56] References Cited

U.S. PATENT DOCUMENTS 3,178,172 4/1965 Lettan ..... 211/50 X
3,327,869 6/1967 Guhl et al. ..... 211/50
4,560,073 12/1985 King ..... 211/181 X
4,651,967 3/1987 McCoy ..... 211/181 X
4,828,118 5/1989 Dearien ..... 211/50
4,923,188 5/1990 Neir ..... 400/613.2 X

FOREIGN PATENT DOCUMENTS 1599780 10/1981 United Kingdom .
2170484 8/1986 United Kingdom .

*Primary Examiner*—Robert W. Gibson, Jr.
*Attorney, Agent, or Firm*—Quarles & Brady

[57] ABSTRACT

For shredding EDP printouts in the form of zig-zag-folded web stacks, a feed mechanism is provided, which has several compartments rearwardly inclined somewhat with respect to the vertical. The webs are removed from the stacks standing therein via the web guide formed by the leading edge of the compartment. A projection formed by a wire crossbeam holds back the stack if it is drawn upwards during removal.

14 Claims, 1 Drawing Sheet

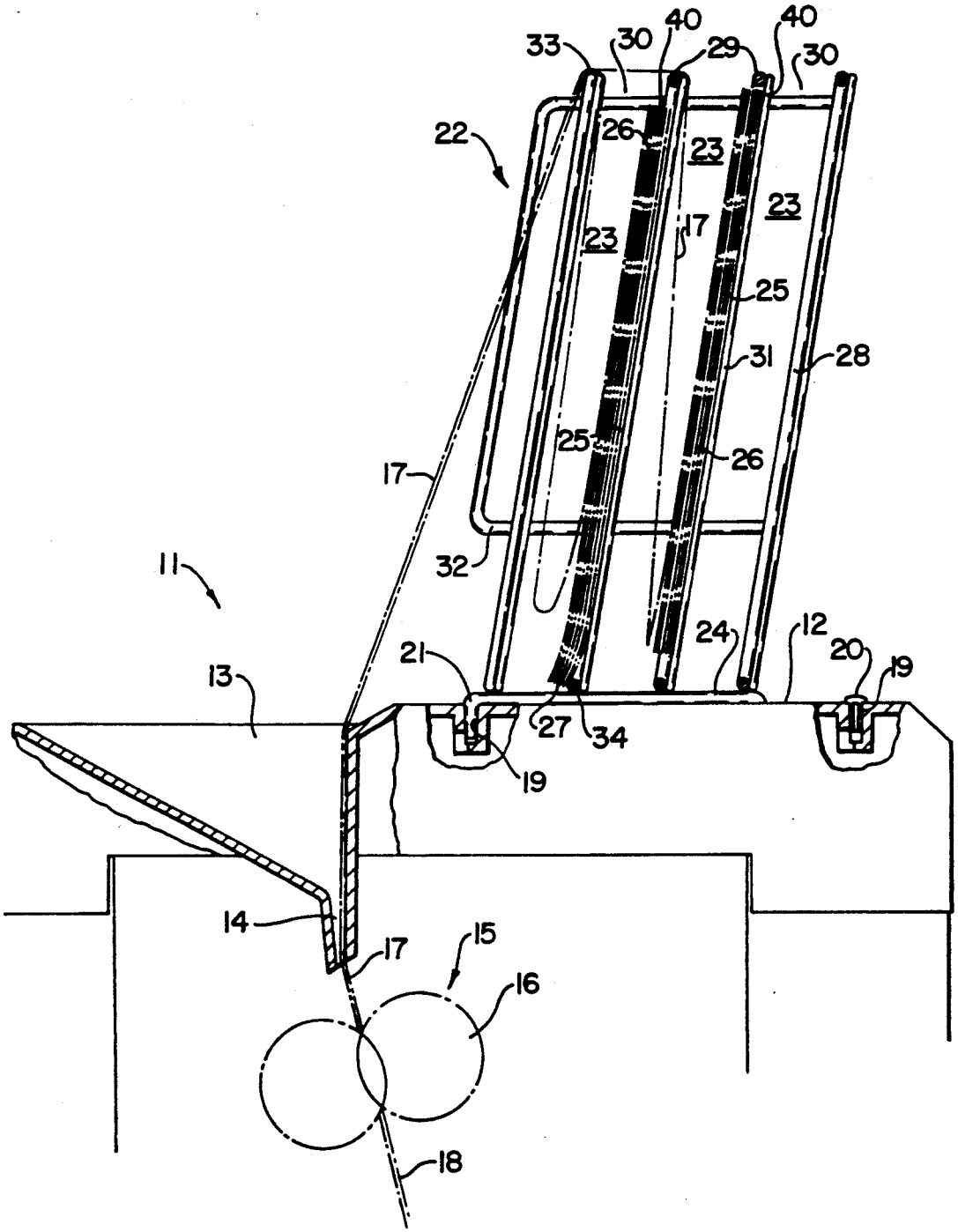
33
30
40
29
40
30
22
26
23
23
23
17
25
31
28
25
26
17
32
11
24
12
21
20
19
13
27
34
19
14
17
15
16
18

FEED MECHANISM TO A DOCUMENT SHREDDER

BACKGROUND OF THE INVENTION

Whereas normally documents, which is understood to mean flat materials and written matter of random type, are fed as individual sheets or stacks to a document shredder, it frequently arises that entire stacks of flat material webs in the form of folded layers, e.g. printouts from data processing equipment, have to be destroyed as a result of their confidentiality. However, shredders are not always designed to be able to shred such stacks into small pieces.

SUMMARY OF THE INVENTION

An object of the invention is therefore to provide a feed mechanism for document shredders enabling the webs to be successively fed in a trouble-free manner. For this purpose, the invention provides at least one compartment in which a folded stack can be placed and from which a web can be removed via a web guide.

This compartment is advantageously arranged in such a way that the folded stack has a slight slope away from the removal side, i.e. from the shredder introduction slot, but has a relatively steep position. Thus, on one side it assumes a defined location on a bearing side, whereas on the other side it is removed or "unstacked", but does not take up a large amount of space. Therefore several compartments can be successively positioned.

The web is preferably removed via the upper, front edge adjacent to the introduction opening. In the case of several loaded compartments, the webs then pass over and beyond the other compartment and jointly into the document shredder. The latter reliably draws in the same due to its engagement with the web.

Particularly in the case of EDP printed matter, hooking together frequently occurs in the marginal area, e.g. on the perforated edges in the case of stacks of zig-zag-folded layers. As a result the stacks can be ripped away on removal and can be ejected out of the insertion opening. Thus, in the vicinity of the latter is preferably provided a projection projecting over the bearing side and against which then strikes the upper stack edge. This offers sufficient resistance and consequently unhooking takes place.

The feed mechanism can be provided with one or more compartments as a cohesive subassembly, which can be fitted to the top of a shredder, e.g. by insertion in slots or openings. However, it is also possible to build up the compartment from individual plate-like elements.

BRIEF DESCRIPTION OF THE DRAWINGS

These and other features of preferred developments of the invention can be gathered from the claims, description and drawing and the individual features can be realized in an embodiment of the invention and in other fields, either singly or in the form of subcombinations and constitute advantageous, independently protectable constructions for which protection is hereby claimed. The single drawing shows a part sectional side view of a feed mechanism at a document shredder.

DETAILED DESCRIPTION OF THE PREFERRED EMBODIMENTS

On its casing a document shredder 11 has an upper delivery surface 12 and an insertion hopper 13, from which a narrow insertion slot 14 leads to a cutting mechanism 15. The cutting mechanism comprising two cutting rollers 16 can draw in a one or multiple-layer flat material 17 and cut it into strips or particles 18.

On the delivery surface are provided several slots 19, which are parallel to one another and to the insertion slot 14 and which are normally closed by insertion ledges 20, whose top forms a document deposit. The ledges 20 are removed from two of these slots and the insertion feet 21 of a feed mechanism 22 are inserted therein.

The feed mechanism comprises a wire construction, which defines three compartments 23, which are bounded at the bottom by a wire bottom strut 24. In the embodiment, the compartments are rearwardly inclined by an angle of 10° with respect to the vertical. This angle of inclination can be between 5 and 45 and preferably between 10° and 20°. The smaller the angle, the more space saving the arrangement of several compartments. However, it must be large enough for a clearly defined contact or bearing side 25 to form, against which can engage a stack 26 of zig-zag-folded layers of a flat material web and which also stands on its lower stack edge 27.

The bearing or contact side 25 is formed by vertical wire members. Its outer periphery is surrounded by a frame 28 made from somewhat thicker wire and namely on the side directed towards the compartment. The upper cross-beam 29 of the frame 28 is formed by a projection, which projects over the contact side 25 into the compartment and namely into the vicinity of the insertion opening 30 of the compartment 23. The upper parts of the members 21 forming the bearing side and running parallel to the crossbeam 29, together with the latter form a web guide via which the web 17 is removed through the insertion opening 30. From there the web moves in a downwardly sloping manner into the insertion slot 14. The subassembly formed from three compartments is stiffened by lateral bow-shaped members 32, which also laterally guide the stack.

The frame 28 also has a bottom crossbeam 34 which, as can be gathered from the drawing, curves the stack in the forwards direction away from the bearing side 25 when it is standing on the bottom strut 24. Several compartments can be simultaneously loaded with stacks 26 and in each case the rear webs run over the insertion openings 30 of the front compartments 23 and then downwards in multilayer form over and beyond the furthest forward web guide 33. Each stack can be formed from multilayer webs.

The feed mechanism can easily be fitted and removed, by removing two ledges 20 and by inserting the feet 21 in the slots 19. The individual compartments are then loaded from above with stacks through the insertion openings 30 and the start of the web is drawn over the upper edge of the compartment forming the web guide 33 and is inserted into the insertion slot 14.

When the cutting mechanism 15 has engaged the webs, the further shredding takes place automatically through the automatic drawing off of the individual layers. It can be seen that hooking together has occured in the central compartment 23. The upwardly drawn web 17 consequently draws the stack upwards, its side which engages bearing side 25 being moved upwards. Its upper stack edge 40 then strikes against the cross-beam or projection 29, so that there is now an adequate resistance to bring about unhooking. The stack then slides downwards again into its initial position.

It is possible to see on the left-hand stack that, when it is positioned normally on the bottom strut 24, it is somewhat forwardly inclined as a result of the lower crossbeam 34, so that the drawoff angle is more obtuse and consequently initial hooking together in the lower region can be more easily stopped.

In the present case only two of the three compartments are loaded. If the third compartment were loaded, the third web would pass away over the others.

The construction from wire is stable and makes it possible to readily establish the filling level. However, it would also be possible to have a lattice construction made from some other material, e.g. plastic. An important advantage is that as a result of the feed mechanism other parts of the shredder, e.g. the front panel remain free. Thus, if the stack was placed in front of the shredder to draw it in from that point, then important controls, e.g. the emptying door would be blocked and operation would be disturbed. The presently described feed mechanism does not get in the way. If the front door is opened for emptying the waste container, as a result of the integrated safety cutout mechanism the shredder stops, but automatically restarts when the door is closed and without requiring any further manipulations. The feed mechanism also does not get in the way when the shredder is used for individual sheets and can consequently remain permanently fitted. Even when continuous web shredding is taking place, additional individual sheets can be fed into the free introduction hopper.

It is therefore also possible to shape into the upper casing boundary one or more compartments, e.g. with a shallower or flatter slope and this would lead to a roughly sawtooth construction.

It is also advantageous for the lower edge of the compartment formed by the bottom strut 24 to have a certain angle with respect to the stack plane defined by the bearing side 25. Thus, during insertion and during each movement resulting from removal, the stack abuts in sloping manner, so that any hooking together with respect to the stack is easily stopped.

We claim:

1. An assembly for shredding a plurality of flat material webs collected from several stacks of folded layers, said assembly comprising:

a document shredder having an insertion slot;

a feed mechanism adjacent said insertion slot, said feed mechanism including:

a plurality of compartments for separately storing each of the several stacks of folded layers, each compartment having a bottom surface, a forward surface and a rearward surface, said forward surface being closest to the shredder insertion slot, each compartment having an opening at its top between said forward and rearward surfaces, said bottom surface and said rearward surface supporting the stack with a flat side of the stack leaning against the rearward surface; and a web guide for guiding the web pulled off of the stack, said web guide being located atop the forward surface of said compartment near its opening, whereby the web guide of a first of said compartment guides all webs collected from the plurality of compartments.

2. The assembly according to claim 1, wherein the opening is an insertion opening for placing the stack into the compartment.

3. The assembly according to claim 1, wherein the rearward surface is angled relative to the bottom surface away from the insertion hopper.

4. A feed mechanism for feeding a plurality of flat material webs collected from several stacks of folded layers to a document shredder insertion slot, said feed mechanism comprising:

a plurality of compartments for separately storing each of the several stacks of folded layers, each compartment having a bottom surface, a forward surface and a vertical rearward surface, said forward surface being closest to the shredder insertion slot, each compartment having an opening at its top between said forward and rearward surfaces, said bottom surface and said rearward surface supporting the stack with a flat side of the stack leaning against the rearward surface;

a web guide for guiding the web pulled off of the stack, said web guide being located atop the forward surface of said compartment near its opening, whereby the web guide of a first of said compartment guides all webs collected from the plurality of compartments; and a projection proximate the top of the rearward surface for limiting the upward movement of a top surface of the stack.

5. A feed mechanism for feeding a plurality of flat material webs collected from several stacks of folded layers to a document shredder insertion slot, said feed mechanism comprising:

a plurality of compartments for separately storing each of the several stacks of folded layers, each compartment having a bottom surface, a forward surface and an upwardly inclined rearward surface, said forward surface being closet to the shredder insertion slot, each compartment having an opening at its top between said forward and rearward surfaces, said bottom surface and said rearward surface supporting the stack with a flat side of the stack leaning against the rearward surface;

a web guide for guiding the web pulled off of the stack, said web guide being located atop the forward surface of said compartment near its opening, whereby the web guide of a first of said compartment guides all webs collected from the plurality of compartment; and a projection proximate the top of the rearward surface for limiting the upward movement of a top surface of the stack.

6. The assembly according to claim 1, wherein said compartment is arranged to maintain the stack angled a way from the insertion slot at between 5° and 45° with respect to the vertical.

7. The assembly according to claim 1, wherein several substantially identically constructed compartments for containing stacks are successively arranged, webs pulled off the stacks at least one of the compartments pass over the insertion openings and the web guides of at least another compartment.

8. The assembly according to claim 1, wherein the feed mechanism is removable unit comprising one or more compartments and which can be jointly fitted to said document shredder.

9. The assembly according to claim 8, wherein the feed mechanism comprises feet engaging in slots on the shredder, the slots being adapted to receive ledges, which define a document depositing surface if they are not engaged by said feet.

10. The assembly according to claim 1, wherein it comprises individual compartments, which can be inserted in slots on said shredder.

11. The assembly according to claim 1, wherein feed mechanism is constructed as a wire structure.

12. The assembly according to claim 1, wherein the compartment is narrow flat in the direction of the stack height with a width to height ratio between 1:5 and 1:10.

13. feed mechanism according to claim 4, wherein on said bottom surface of said compartment, on which a lower narrow stack side of the stack stands, a second projection is provided, which bends the lower narrow stack side away from the rearward surface.

14. A feed mechanism according to claim 1, wherein a bottom side of the compartment, on which a lower narrow side of the stack stands, has a slope with respect to a stack supporting side of the compartment.

* * * * *